US005131717A

United States Patent [19]

Kaminiski et al.

[11] Patent Number: 5,131,717

[45] Date of Patent: Jul. 21, 1992

[54] RECLINING CHAIR HAVING A MOVABLE SEAT BACK AND A MOVABLE SEAT BOTTOM

[75] Inventors: Stephen H. Kaminiski, Newbury Park; Michael J. Botich, Oxnard; Mark E. Murphy, Newbury Park, all of Calif.

[73] Assignee: The Pelton & Crane Company, Charlotte, N.C.

[21] Appl. No.: 589,869

[22] Filed: Sep. 28, 1990

[51] Int. Cl.[5] ..... A47C 1/02

[52] U.S. Cl. ..... 297/316; 297/321; 297/340; 297/327

[58] Field of Search ..... 297/316, 319, 320, 321, 297/340, 83, 327

[56] References Cited

U.S. PATENT DOCUMENTS

| | | | |
|---|---|---|---|
| 2,497,395 | 2/1950 | Cramer, Sr. . | |
| 2,655,981 | 10/1953 | Whittingham et al. | 297/316 X |
| 3,339,972 | 9/1967 | Fletcher | 297/83 X |
| 3,719,391 | 3/1973 | Neri . | |
| 3,856,346 | 12/1974 | Herman . | |
| 4,004,763 | 1/1977 | Bunnell, III et al. . | |
| 4,195,878 | 4/1980 | Cycowicz et al. | 297/83 |
| 4,367,895 | 1/1983 | Pacitti et al. | 297/83 X |
| 4,386,803 | 6/1983 | Gilderbloom | 297/83 X |
| 4,547,017 | 10/1985 | Lescure . | |
| 4,613,186 | 9/1986 | LaPointe . | |
| 4,796,952 | 1/1989 | Piretti | 297/316 |

*Primary Examiner*—Kenneth J. Dorner
*Assistant Examiner*—J. Bonifanti
*Attorney, Agent, or Firm*—Lawrence C. Edelman

[57] ABSTRACT

A reclining chair has a seat back and a seat bottom which are pivotally attached to opposite ends of a rocking cradle or support frame, which itself is pivotally mounted to a base. The seat back and the seat bottom are interconnected such that an end of the seat bottom proximate to the seat back is raised as the seat back is lowered. Conversely, as the end of the seat bottom proximate to the seat back is lowered, the seat back is raised. The opposite or remote end of the seat bottom is maintained at substantially the same elevation as the end of the seat bottom proximate the seat back, whereby the seat bottom is maintained in a substantially constant orientation relative to the horizontal as it is raised and lowered.

25 Claims, 7 Drawing Sheets

RECLINING CHAIR HAVING A MOVABLE SEAT BACK AND A MOVABLE SEAT BOTTOM

FIELD OF THE INVENTION

The present invention relates to reclining chairs, and, more particularly, to such chairs that are adapted to move between an upright (i.e., sitting) position and a reclined (i.e., supine) position. Examples of such chairs include dental patient chairs, barber chairs, automotive seats, lounge chairs, medical examination chairs, leisure chairs, etc.

BACKGROUND OF THE INVENTION

The prior art is replete with numerous examples of reclining and/or articulated chairs and the like. Some of these chairs are motorized (see, for example, U.S. Pat. Nos. 3,719,391 and 4,004,763), while others are of a non-motorized variety (see, for example, U.S. Pat. Nos. 2,497,395; 3,856,346; 4,195,878; 4,547,017 and 4,613,186).

With respect to the motorized reclining chairs, the one disclosed in U.S. Pat. No. 3,719,391 is adapted for use as a dental chair and is provided with slidable seat and backrest frames which move in a converging manner in response to a lowering of the backrest, thereby avoiding movement of the patient's body on the seat and the backrest as the chair is moved between a sitting position and a reclined position. A complicated and therefore expensive drive mechanism, which includes an electrically-driven worm screw, is employed to effect the desired movement of the seat and backrest frames.

Turning now to the non-motorized reclining chairs, the one disclosed in U.S. Pat. No. 4,547,017 is designed to maintain a user in a position which is very close to equilibrium in all relative positions of the backrest and the seat. As a result, the user may modify the position of the chair without any need to exert an appreciable force on its backrest and/or seat. The armrest and the backrest of the chair are provided with grooves sized and shaped to receive pins or rollers which cooperate with the grooves to control the relative movement of the backrest and the seat as the chair is moved between an upright position and a reclined position.

SUMMARY OF THE INVENTION

In accordance with the present invention, a new and improved reclining chair includes a reclining support frame which is pivotally connected at one end to a seat back and at an opposite end to a seat bottom. The support frame is pivotally mounted to a base intermediate the ends thereof. The seat back and the seat bottom are interconnected such that the rear most edge of the seat bottom is raised as the seat back is lowered and such that the seat back is raised as the rear most edge of the seat bottom is lowered. As the seat bottom is raised and lowered due to the rotation of the support frame, it is maintained in a substantially constant orientation relative to the horizontal. Provision is also made to move the seat bottom and the seat back toward each other as the seat back is lowered and the seat bottom is raised (i.e., as the chair is moved from an upright position to a reclined position) and for moving the seat bottom and the seat back away from each other as the seat back is raised and the seat bottom is lowered (i.e., as the chair is moved from a reclined position to an upright position).

The movement of the seat back and the seat bottom can be effected solely by the transfer of body weight from the seat bottom to the seat back or from the seat back to the seat bottom. Alternatively, such movement can be effected automatically by, for instance, the use of an electric motor or any other power source. When a motor is utilized it may also function as a mechanical lock for locking the chair in any desired position within its range of motion.

BRIEF DESCRIPTION OF THE DRAWINGS

For a better understanding of the present invention, reference is made to the following description of various exemplary embodiments considered in conjunction with the accompanying drawings in which.

DESCRIPTION OF THE EXEMPLARY EMBODIMENTS

Although the present invention is applicable to many different types of reclining chairs, such as a barber chair, an automotive seat, a lounge chair, a medical examination chair, a leisure chair, etc., it is especially suitable for use as a dental patient chair. Accordingly, the present invention will be described below as a dental patient chair.

Figure 1:
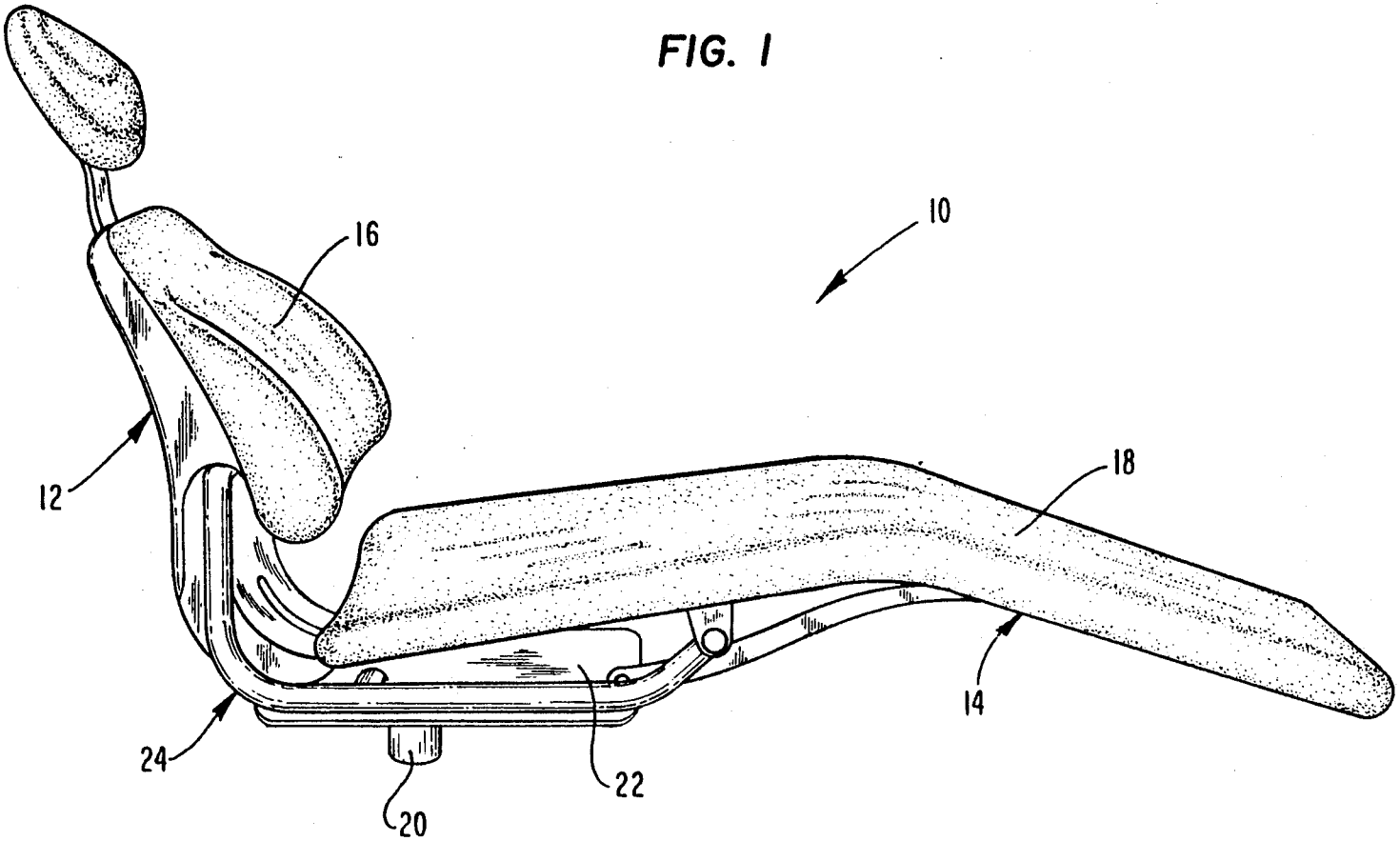
FIG. 1 is a perspective view of a reclining chair constructed in accordance with one exemplary embodiment of the present invention, the chair being shown with cushions and in an upright position.

Referring to FIG. 1, a reclining dental patient chair 10 is shown in an upright position in which a seat back 12 is arranged in a generally vertical orientation and a seat bottom 14 is arranged in a generally horizontal orientation. The seat back 12 and the seat bottom 14 are provided with preformed cushions 16 and 18, respectively, which are easily removed for cleaning, replacement and/or repair. A pedestal 20 supports a base plate 22. A cradle (i.e., rocking support frame) 24 is mounted for pivotal (i.e., rocking) movement relative to the base plate 22.

Figure 2:
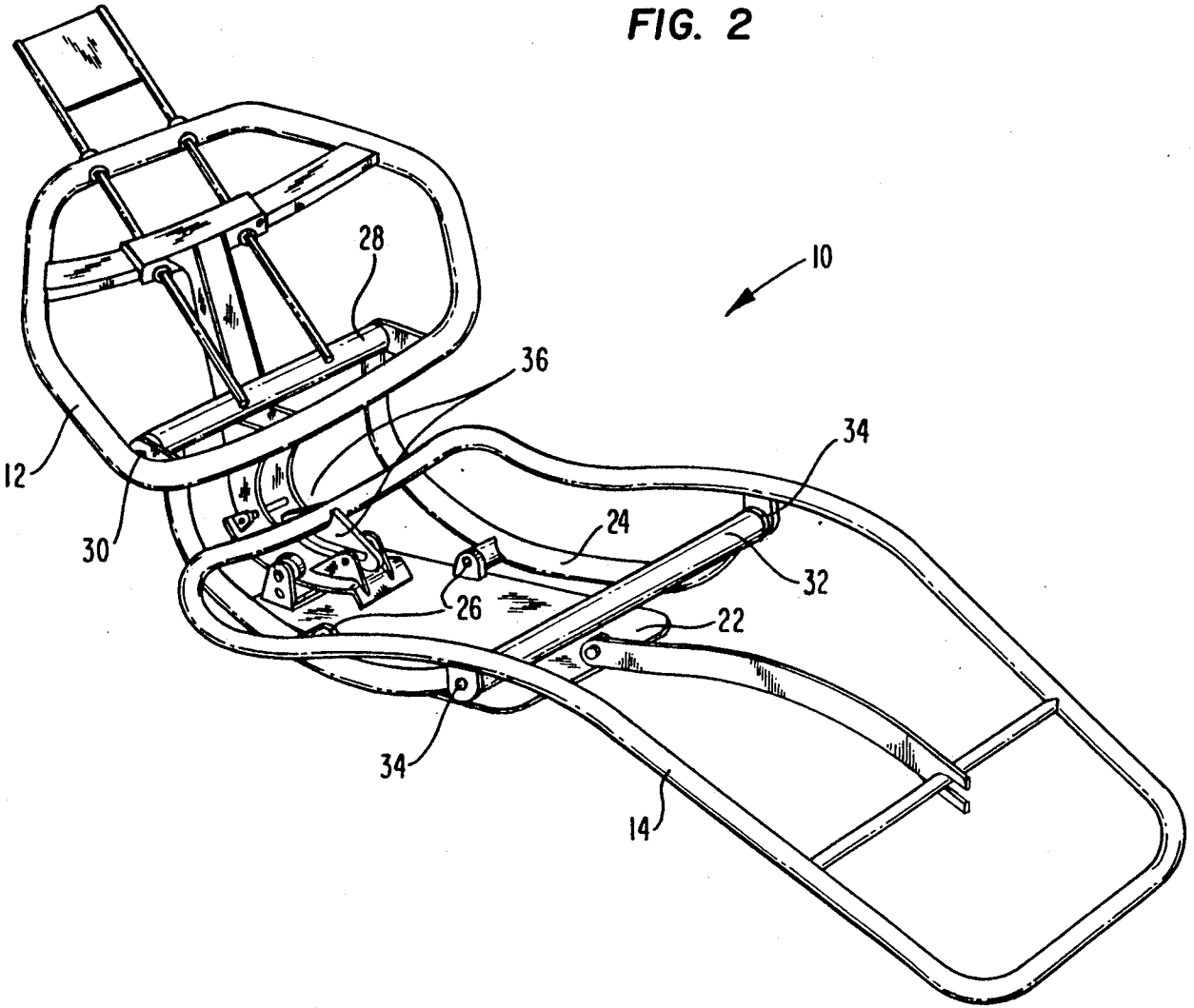
FIG. 2 is a perspective view of the chair illustrated in FIG. 1, the cushions having been removed for purposes of clarity.

With reference now to FIG. 2, the cradle 24 is pivotally attached to the base plate 22 by a cradle/base plate pivot 26, which is stationary relative to the base plate 22 and which is located generally in the middle of the cradle 24. A rear end 28 of the cradle 24 is pivotally attached to the seat back 12 by a cradle/seat back pivot 30, which pivots conjointly with the rear end 28 of the cradle 24 and therefore is movable relative to the base plate 22 in response to the pivotal movement of the cradle 24 about the cradle/base plate pivot 26. A front end 32 of the cradle 24 is pivotally attached to the seat bottom 14 by a cradle/seat bottom pivot 34, which pivots conjointly with the front end 32 of the cradle 24 and therefore is movable relative to the base plate 22 in response to the pivotal movement of the cradle 24 about the cradle/base plate pivot 26. A connector assembly 36, which will be described in greater detail below, interconnects the seat back 12 and the seat bottom 14 in a manner which will also be described in detail below.

Figure 3:
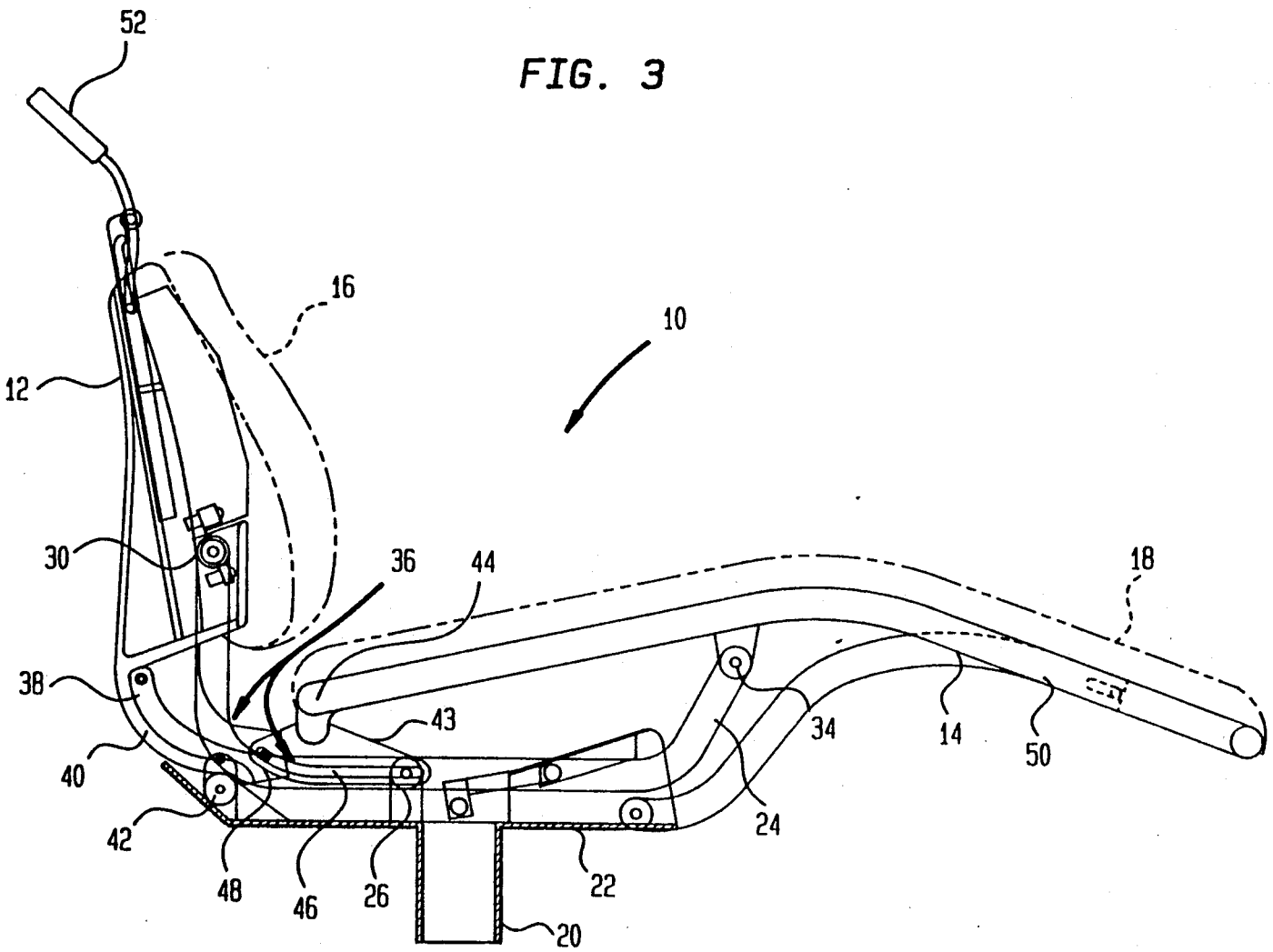
FIG. 3 is a side elevational view of the chair illustrated in FIGS. 1 and 2, the cushions being shown in phantom.
Figure 4:
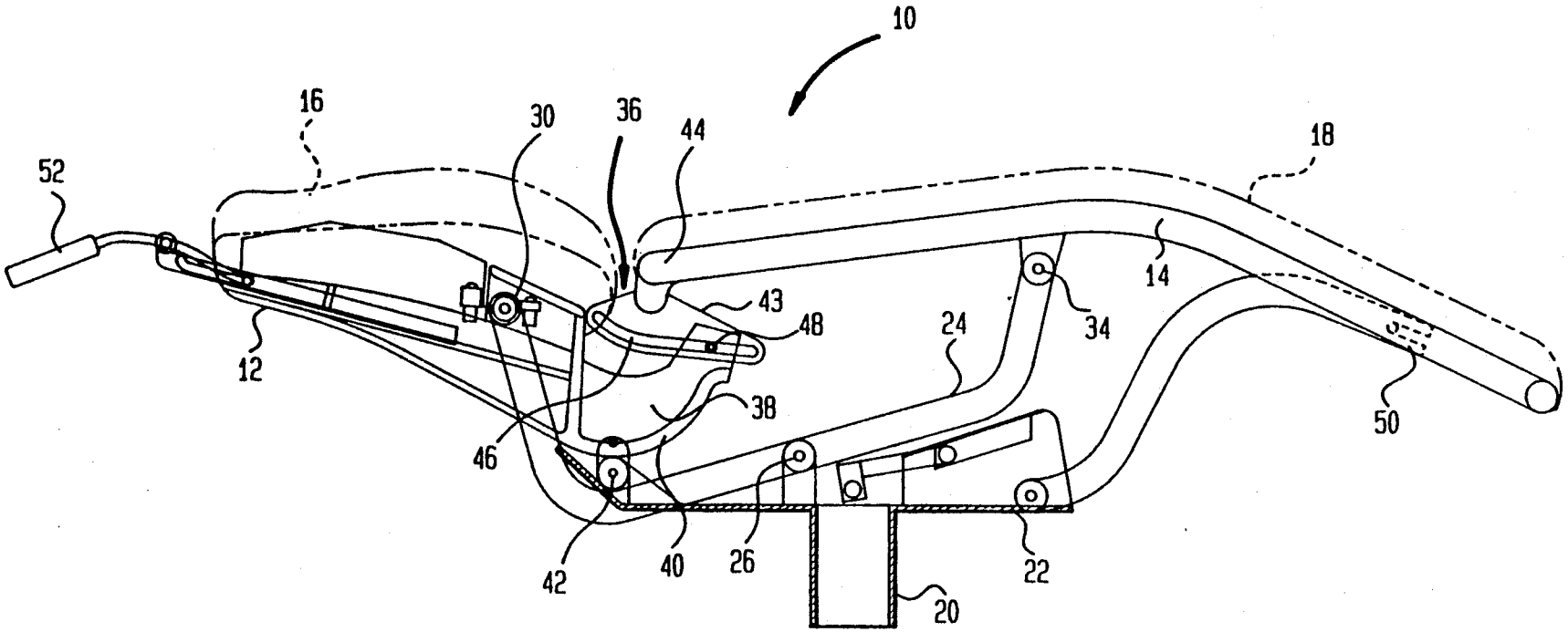
FIG. 4 is a side elevational view of the chair illustrated in FIG. 3 after it has been moved from its upright position to a reclined position.
Figure 5:
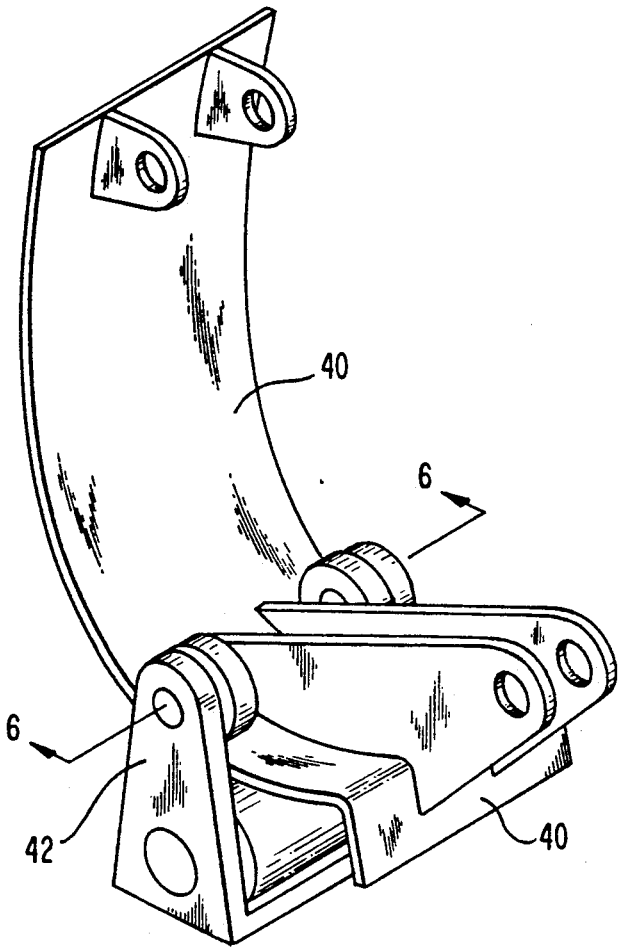
FIG. 5 is a detailed perspective view of a cam and roller assembly employed by the chair illustrated in FIGS. 1–4.
Figure 6:
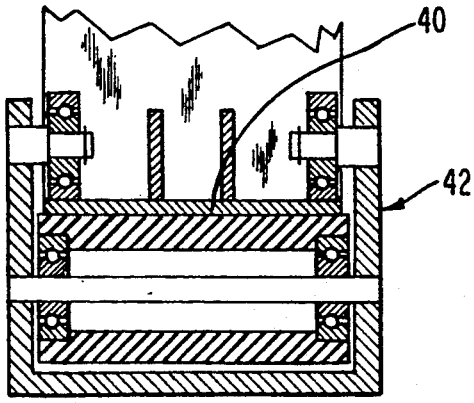
FIG. 6 is cross-sectional view, taken along section line 6—6 of FIG. 5 and looking in the direction of the arrows, of the cam and roller assembly shown in FIG. 5.

Referring generally to FIGS. 3 and 4, but as best seen in FIGS. 5 and 6, the connector assembly 36 includes a seat back extension 38, which depends from the seat back 12 and which carries an arcuate bearing plate 40. The arcuate bearing plate 40, which pivots conjointly with the seat back 12, has a shape selected to cause the pivotal movement of the cradle 24 in a manner to be described more fully below. A roller assembly 42, which is mounted on the base plate 22 in a stationary location, guides the arcuate bearing plate 40 as it moves in response to the pivotal movement of the seat back 12 about the cradle/seat back pivot 30. Thus, the arcuate bearing plate 40 and the roller assembly 42 cooperate to form a pair of connector elements which interconnects the seat back 12 and the base plate 22 in a manner to be described in greater detail below.

Referring still to FIGS. 3 and 4, the connector assembly 36 also includes a seat bottom extension 43, which depends from a rear end 44 of the seat bottom 14 and which is provided with a slot 46. The seat bottom extension 43 and hence with the slot 46, which pivots conjointly with the seat bottom 14, receives a roller 48 carried by the seat back extension 38. The shape of the slot 46 is selected to input a return force to the seat back 12 and also to maintain a substantially constant orientation of the seat bottom 14 relative to the horizontal as the chair 10 is moved between its upright position illustrated in FIG. 3 and its reclined position illustrated in FIG. 4. Thus, the slot 46 and the roller 48 cooperate to form another pair of connector elements which interconnects the seat back 12 and the seat bottom 14 in a manner to be described in greater detail below.

In order to move the chair 10 from its upright position illustrated in FIG. 3 to its reclined position illustrated in FIG. 4, a user or occupant of the chair 10 would lean back allowing his body weight to force the seat back 12 downward. Because the cradle/seat back pivot 30 moves downward with the seat back 12, due to the connection of the seat back 12 to the base plate 22 via the interaction of the arcuate bearing plate 40 and the roller assembly 42, the rear end 28 of the cradle 24 is also caused to move downward, resulting in the pivotal or rocking movement of the cradle 24 about the cradle/base plate pivot 26 and hence the upward movement of the front end 32 of the cradle 24. Because the front end 32 of the cradle 24 is attached to the seat bottom 14 at the cradle/seat bottom pivot 34, the pivotal movement of the cradle 24 results in the upward movement of a front end 50 of the seat bottom 14.

As the front end 50 of the seat bottom 14 moves upward, slot 46 and the roller 48 interact to translate the downward movement of the seat back 12 into an upward movement of the rear end 44 of the seat bottom 14. Because the rear end 44 of the seat bottom 14 moves at approximately the same rate as the front end 50 of the seat bottom 14, the seat bottom 14 is maintained at a substantially constant orientation (i.e., angle) relative to the horizontal as the chair 10 is moved between its upright position and its reclined position. Thus, the seat back 12 functions like a load transfer lever (i.e., like a pry bar) to lift the seat bottom 14 without the use of any external power besides that provided by the user or occupant of the chair 10.

As the chair 10 moves from its upright position to its reclined position, the connector assembly 36, in general also functions to move the seat back 12 and the seat bottom 14 toward each other, thereby maintaining the proper ergonomic relationship between the body of the user and the surface (i.e., the seat back 12 and the seat bottom 14) of the chair 10 throughout its full range of motion. Maintaining the proper ergonomic relationship between the user's body and the chair 10 is beneficial because it: (i) maintains a substantially constant head position of the user relative to a headrest 52 extending upwardly from the seat back 12; (ii) minimizes compression and elongation of the user's spinal column; and (iii) virtually eliminates displacement of the user's clothing.

The change in elevation of the seat bottom 14 can be used to input the force required to move chair 10 from its reclined position to its upright position. The shape of the slot 46 also aids in inputting the return force to the seat back 12. This return force can be supplied by the user without the assistance of any external power source.

The chair 10 is capable of assuming any position between its upright position and its reclined position. Any suitable and conventional mechanical lock (not shown) can be employed to maintain the chair 10 in a desired position so that the occupant or user can relax while the chair 10 resists forces applied by the dentist or another non-occupant of the chair 10.

Figure 7:
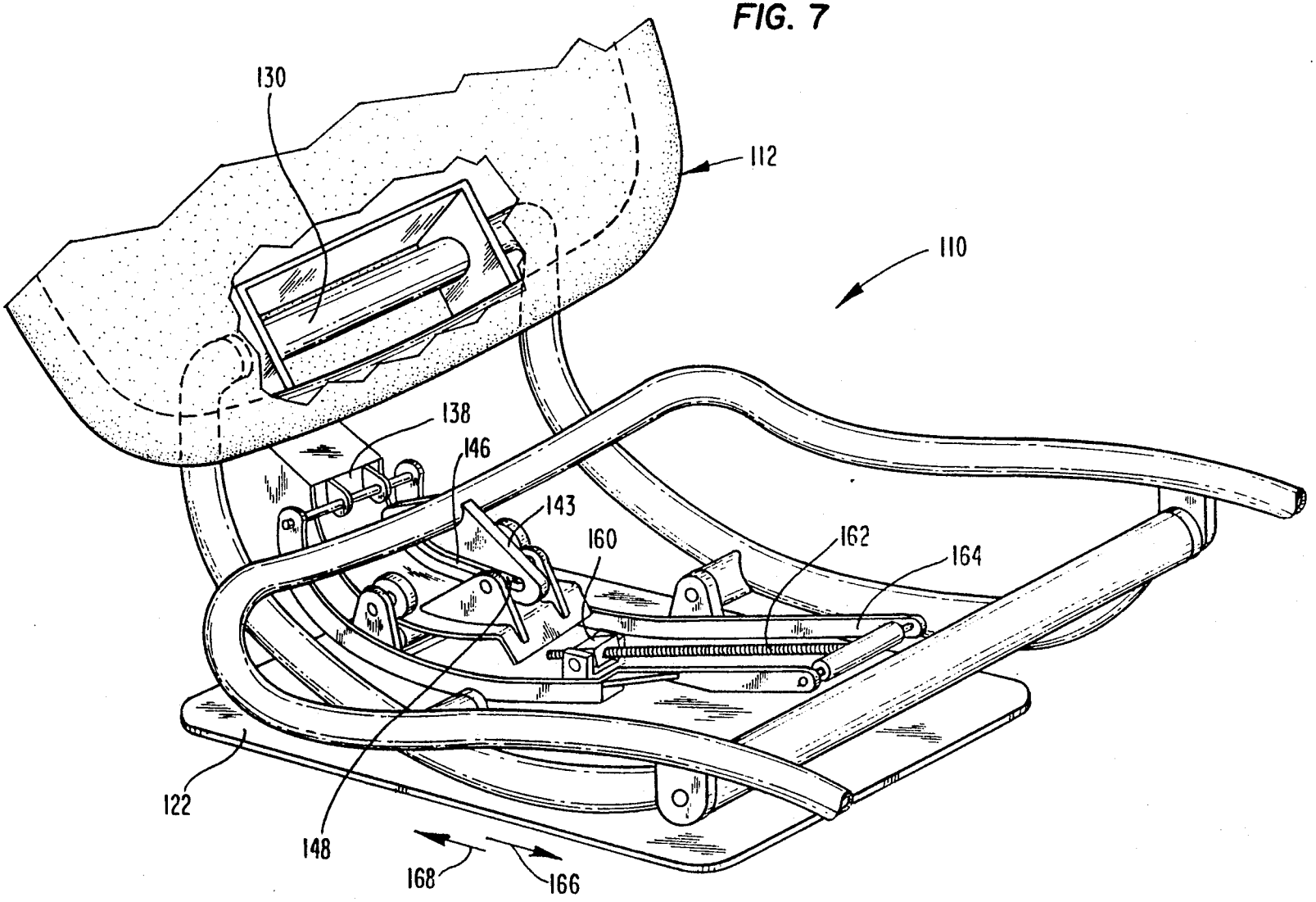
FIG. 7 is a perspective view of a portion of a reclining chair constructed in accordance with another exemplary embodiment of the present invention, portions of the chair being broken away for purposes of clarity.
Figure 8:
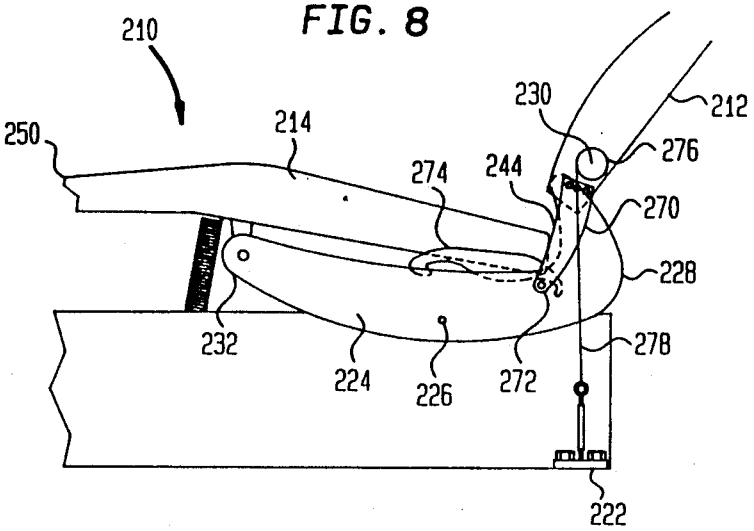
FIG. 8 is a diagrammatic side view of a reclining chair constructed in accordance with yet another exemplary embodiment of the present invention, the chair being shown in an upright position.
Figure 9:
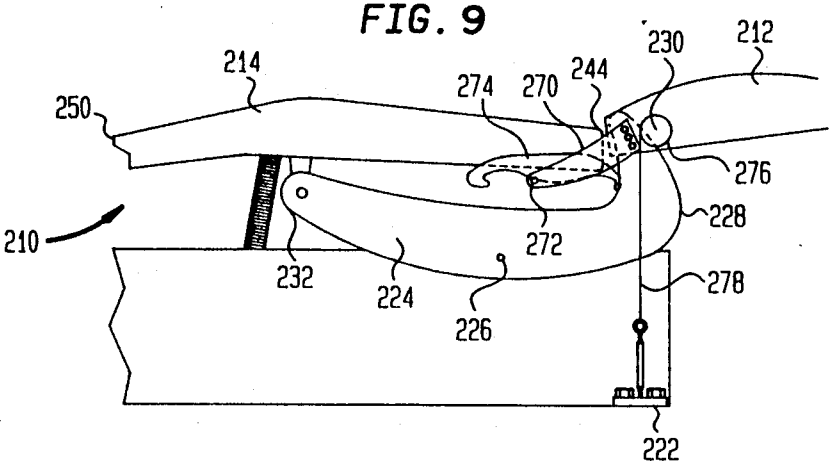
FIG. 9 is a diagrammatic side view of the chair illustrated in FIG. 8 after it has been moved from its upright position to to a reclined position.

Two other exemplary embodiments of a reclining chair constructed in accordance with the present invention are illustrated in FIG. 7 and in FIGS. 8 and 9. Elements illustrated in FIG. 7 and in FIGS. 8 and 9 which correspond to the elements described above with respect to FIGS. 1–6 are designated by corresponding reference numerals increased by one hundred and two hundred, respectively. The embodiment of FIG. 7 and the embodiment of FIGS. 8 and 9 operate in the same manner as the embodiment of FIGS. 1–6 unless otherwise stated.

With reference to FIG. 7, a reclining chair 110 is made automatic by mounting motor-driven gear nut 160 on a base plate 122. A lead screw shaft 162 of the motor-driven gear nut 160 is connected to one end of a yoke arm 164, which is slidably mounted on the base plate 122. An opposite end of the yoke arm 164 is pivotally attached to a seat back extension 138, which depends from the seat back 112. Upon actuation of the motor-driven gear nut 160 and the resulting linear motion of the lead screw shaft 162, the yoke arm 164 is moved (i.e., extended) along the base plate 122 in the direction indicated by arrow 166, thereby pivoting the seat back 112 downward about a cradle/seat back pivot 130 until the chair 110 reaches its reclined position (i.e., with its seat back 112 arranged in a generally horizontal orientation). By reversing the direction of linear motion of the lead screw shaft 162, the yoke arm 164 is moved (i.e., retracted) along the base plate 122 in a direction indicated by arrow 168, thereby pivoting the seat back 112 upward about the cradle/seat back pivot 130 until the chair 110 reaches its upright position (i.e., with its seat back 112 arranged in a generally vertical orientation). In this embodiment, the motor 160 functions as a mechanical locking mechanism for maintaining the chair 110 in any desired position between its upright position and its reclined position.

Referring now to FIGS. 8 and 9, a reclining chair 210 has a seat back 212, which is provided on each side with a seat back extension 270 having a roller 272. The chair 210 also includes a seat bottom 214, which is provided on each side with a plate having a bearing surface 274 along which rides a corresponding one of the rollers 272. Thus, each of the rollers 272 and its corresponding one of the bearing surfaces 274 cooperate to form a pair of connector elements which interconnects the seat back 212 and the seat bottom 214 in a manner to be described in greater detail below. A pulley 276, which is arranged coaxially with respect to a cradle/seat back pivot 230, rotates conjointly with the seat back 212 to wind and unwind a cable 278, which is attached at one end to the pulley 276 and at an opposite end to a base plate 222. Thus, the pulley 276 and the cable 278 cooperate to form another pair of connector elements which interconnects the seat back 212 and the base plate 222 in a manner to be described in greater detail below.

In this embodiment, as the chair 210 moves from its upright position illustrated in FIG. 8 to its reclined position illustrated in FIG. 9, the winding of the cable 278 about the pulley 276 causes the cradle/seat back pivot 230 to move downward. The downward movement of the seat back 212 and the cradle/seat back pivot 230 results, in turn, in the downward movement of a rear end 228 of a cradle 224 and the resulting pivotal movement of the cradle 224 about a cradle/base plate pivot 226. As the cradle 224 pivots about the cradle/-base plate pivot 226, a front end 232 of the cradle 224 is moved upward, thereby lifting a front end 250 of the seat bottom 214. A rear end 244 of the seat bottom 214 is also lifted (i.e., raised) by the cooperative efforts of the rollers 272 and their associated bearing surface 274. Because both the front end 250 and the rear end 244 of the seat bottom 214 are raised at the same rates, the orientation of the seat bottom 214 relative to the horizontal can be maintained substantially constant.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

We claim:

1. A reclining chair, comprising a support frame pivotally connected at one end to a seat back and at an opposite end to a seat bottom; mounting means for pivotally mounting said support frame to a base intermediate said ends thereof; first connecting means for interconnecting said seat back to said base such that one end of said seat back proximate to said base is lowered in response to the downwardly pivoting movement of said seat back relative to said support frame as said chair is moved from an upright position to a reclined position and such that said one end of said seat back is raised in response to the upwardly pivoting movement of said seat back relative to said support frame as said chair is moved from said reclined position to said upright position, said first connecting means including an arcuate bearing plate carried by a first extension depending from said one end of said seat back such that said arcuate bearing plate is movable conjointly with said seat back as said chair is moved between said upright position and said reclined position and a roller assembly attached to said base, said arcuate bearing plate being movably captured within said roller assembly such that said roller assembly guides said arcuate bearing plate as said arcuate bearing plate moves in response to the movement of said seat back as said chair is moved between said upright position and said reclined position; and second connecting means for interconnecting said seat back and said seat bottom such that one end of said seat bottom proximate to said seat back is raised as said seat back is lowered and such that said seat back is raised as said one end of said set bottom is lowered, said seat bottom being maintained in a substantially constant orientation relative to the horizontal as said seat bottom is raised and lowered, said second connecting means also creating relative movement between said seat bottom and said seat back such that the distance between said one end of said seat back and said one end of said seat bottom decreases as said seat back is lowered and said seat bottom is raised and such that the distance between said one end of said seat back and said one end of said seat bottom increases as said seat back is raised and said seat bottom is lowered, said second connecting means including a roller carried by said first extension such that said roller is movable conjointly with said seat back as said chair is moved between said upright position and said reclined position and a second extension depending from said one end of said seat bottom such that said second extension is movable conjointly with said one end of said seat bottom, said second extension being provided with a slot and said roller being movably received within said slot such that said roller guides said second extension as said second extension moves in response to the movement of said seat bottom as said chair is moved between said upright position and said reclined position.

2. A reclining chair according to claim 1, further comprising driving means for automatically driving said seat back between an upright position and a reclined position.

3. A reclining chair according to claim 1, further comprising locking means for locking said seat back and said seat bottom in predetermined positions relative to each other.

4. A reclining chair according to claim 1, further comprising a first cushion removably attached to said seat back and a second cushion removably attached to said seat bottom.

5. A reclining chair according to claim 1, wherein said seat back, said seat bottom and said support frame have a tubular construction.

6. A reclining chair movable between an upright position and a reclined position, comprising:

a base;

a cradle mounted on said base for pivotal movement relative thereto about a first pivot axis intermediate first and second ends of said cradle, said first end of said cradle including a second pivot axis, which is movable conjointly with said first end of said cradle as said cradle pivots bout said first pivot axis and which is therefore pivotable about said first pivot axis, and said second end of said cradle including a third pivot axis, which is movable conjointly with said second end of said cradle as said cradle pivots about said first pivot axis and which is therefore pivotable about said first pivot axis, whereby said first pivot axis is common to both said second pivot axis and said third pivot axis;

a seat back having a first end and a second end, which is below said first end of said seat back when said chair is in its upright position, said seat back being pivotally attached to said first end of said cradle about said second pivot axis;

a seat bottom having a first end remote from said seat back and a second end proximate to said seat back, said seat bottom being pivotally attached intermediate said first and second ends thereof to said second end of said cradle about said third pivot axis;

first connecting means for interconnecting said seat back to said base such that said second pivot axis is lowered in response to the downward movement of said seat back as said chair is moved from its upright position to its reclined position, thereby causing the pivotal movement of said cradle about said first pivot axis in a first arcuate direction, and such that said second pivot axis is raised in response to the pivotal movement of said cradle about said first pivot axis in a second arcuate direction, which is opposite to said first arcuate direction, upon the downward movement of said seat bottom as said chair is moved from its reclined position toward its upright position, said first connecting means including a first connector element attached to said seat back such that said first connector element is movable conjointly with said seat back as said chair is moved between its upright position and its reclined position and a second connector element attached to said base and cooperating with said first connector element to control the elevation of said second pivot axis as said second pivot axis is lowered and raised; and second connecting means for interconnecting said seat back to said seat bottom such that said second end of said seat bottom is raised and moved continuously toward said second end of said seat back as said cradle is pivoted in said first arcuate direction during the movement of said chair from its upright position toward its reclined position and such that said second end of said seat bottom is lowered and moved continuously away from said second end of said seat back as said cradle is pivoted in said second arcuate direction during the movement of said chair from its reclined position toward its upright position, whereby the proper ergonomic relationship between a user's body and said seat back and said seat bottom is maintained as said chair is moved between its upright position and its reclined position, said second connecting means including a third connector element attached to said seat back such that said third connector element is movable conjointly with said seat back as said chair is moved between its upright position and its reclined position and a fourth connector element attached to said seat bottom and cooperating with said third connector element to control the elevation of said second nd of said seat bottom as said second end of said seat bottom is raised and lowered.

7. A reclining chair according to claim 6, wherein said second connector element includes first guiding means for guiding said first connector element as said first connector element moves in response to the movement of said seat back as said chair is moved between its upright position and its reclined position.

8. A reclining chair according to claim 7, wherein said first connector element is an arcuate bearing plate carried by a first extension depending from said second end of said seat back and said first guiding means is a roller assembly mounted on said base, said arcuate bearing plate being movably captured within said roller assembly.

9. A reclining chair according to claim 8, wherein said third connector element includes second guiding means attached to said first connector element for guiding said fourth connector element as said fourth connector element moves in response to the movement of said seat bottom as said chair is moved between its upright position and its reclined position.

10. A reclining chair according to claim 9, wherein said fourth connector element includes a second extension depending from said second end of said seat bottom and having a slot provided therein and said second guiding means is a roller carried by said first extension and movably received within said slot of said second extension.

11. A reclining chair according to claim 6, wherein said first connector element includes a pulley attached to said second end of said seat back and said second connector element includes a cable attached between said pulley and said base such that said cable is wound about said pulley as said chair is moved from its upright position toward its reclined position and such that said cable is unwound from said pulley as said chair is moved from its reclined position toward its upright position.

12. A reclining chair according to claim 11, wherein said third connector element includes a roller depending from said second end of said seat back and said fourth connector element includes a bearing surface attached to said seat bottom, said roller being movable along said bearing surface.

13. A reclining chair according to claim 6, wherein said second end of said cradle is attached to said seat bottom such that said first end of said seat bottom is raised in response to the pivotal movement of said cradle in said first arcuate direction and is lowered in response to the pivotal movement of said cradle in said second arcuate direction.

14. A reclining chair according to claim 13, wherein said first and second ends of said seat bottom are raised and lowered at the same rates, whereby the orientation of said seat bottom relative to the horizontal is maintained as said chair is moved between its upright and reclined positions.

15. A reclining chair according to claim 6, further comprising driving means for automatically driving said chair between its upright and reclined positions.

16. A reclining chair according to claim 6, further comprising locking means for said seat back and said seat bottom in predetermined positions relative to each other.

17. A reclining chair according to claim 6, further comprising a first cushion removably attached to said seat back and a second cushion removably attached to said seat bottom.

18. A reclining chair according to claim 6, wherein said seat back, said seat bottom and said cradle have a tubular construction.

19. A reclining chair according to claim 6, wherein said first end of said cradle is positioned on one side of said pivot axis and said second end of said cradle is positioned on an opposite side of said pivot axis.

20. A reclining chair according to claim 19, wherein said second pivot axis is located at a first elevation, which is higher than that of said first pivot axis, when said chair is in its upright position and at a second elevation, which is higher than that of said first pivot axis but which is lower than said first elevation, when said chair is in its reclined position.

21. A reclining chair according to claim 20, wherein said third pivot axis is located at a third elevation, which is higher than that of said first pivot axis, when said chair is in its upright position and at a fourth elevation, which is higher than that of said first pivot axis and which is higher than said third elevation, when said chair is in its reclined position.

22. A reclining chair according to claim 6, wherein said third and fourth connector elements cooperate to permit said seat back to function like a load transfer lever to thereby control the elevation of said second end of said seat bottom as said second end of said seat bottom is raised and lowered.

23. A reclining chair movable between an upright position and a reclined position, comprising:

a base;

a cradle mounted on said base for pivotal movement relative thereto about a first pivot axis intermediate first and second ends of said cradle;

a seat back having a first end and second end, which is below said first end of said seat back when said chair is in its upright position, said seat back being pivotally attached to said first end of said cradle about a second pivot axis, which is movable conjointly with said first end of said cradle as said cradle pivots about said first pivot axis;

a seat bottom having a first end remote from said seat back and a second end proximate to said seat back, said seat bottom being pivotally attached intermediate said first and second ends thereof to said second end of said cradle about a third pivot axis, which is movable conjointly with said second end of said cradle as said cradle pivots about said first pivot axis;

first connecting means for interconnecting said seat back to said base such that said second pivot axis is lowered in response to the downward movement of said seat back as said chair is moved from its upright position to its reclined position, thereby causing the pivotal movement of said cradle about said first pivot axis in a first arcuate direction, and such that said second pivot axis is raised in response to the pivotal movement of said cradle about said first pivot axis in a second arcuate direction, which is opposite to said first arcuate direction, upon the downward movement of said seat bottom as said chair is moved from its reclined position toward its upright position, said first connecting means including an arcuate bearing plate carried by a first extension depending form said second end of said seat back such that said arcuate bearing plate is movable conjointly with said seat back as said chair is moved between its upright position and its reclined position and a roller assembly attached to said base, said arcuate bearing plate being movably captured within said roller assembly such that said roller assembly guide said arcuate bearing plate as said arcuate bearing plate moves in response to the movement of said seat back as said chair is moved between its upright position and its reclined position; and second connecting means for interconnecting said seat back to said seat bottom such that said second end of said seat bottom is raised and moved toward said second end of said seat back as said cradle is pivoted in said first arcuate direction during the movement of said chair from its upright position toward its reclined position and such that said second end of said seat bottom is lowered and moved away from said second end of said seat back as said cradle is pivoted in said second arcuate direction during the movement of said chair from its reclined position toward its upright position, said second connecting means including a roller carried by said first extension such that said roller is movable conjointly with said seat back as said chair is moved between its upright position and its reclined position and a second extension depending from sad second end of said seat bottom such that said second extension is movable conjointly with said second end of said seat bottom, said second extension being provided with a slot and said roller being movably received within said slot such that said roller guides said second extension a said second extension moves in response to the movement of said seat bottom as said chair is moved between its upright position and its reclined position.

24. A reclining chair movable between an upright position and a reclined position, comprising:

a base;

a cradle mounted on said base for pivotal movement relative thereto about a first pivot axis intermediate first and second ends of said cradle;

a seat back having a first end and a second end, which is below said first end of said seat back when said chair is in its upright position, said seat back being pivotally attached to said first end of said cradle about a second pivot axis, which is movable conjointly with said first end of said cradle as said cradle pivots about said first pivot axis;

a seat bottom having a first end remote from said seat back and a second end proximate to said seat back, said a seat bottom being pivotally attached intermediate said first and second ends thereof to said second end of said cradle about a third pivot axis, which is movable conjointly with said second end of said cradle as said cradle pivots about said first pivot axis;

first connecting means for interconnecting said seat back to said base such that said second pivot axis is lowered in response to the downward movement of said seat back as said chair is moved from its upright position to its reclined position, thereby causing the pivotal movement of said cradle about said first pivot axis in a first arcuate direction, and such that said second pivot axis is raised in response to the pivotal movement of said cradle about said first pivot axis in a second arcuate direction, which is opposite to said first arcuate direction, upon the downward movement of said seat bottom as said chair is moved from its reclined position towards its upright position, said first connecting means including a pulley attached to said second end of said seat back and a cable attached between said pulley and said base such that said cable is wound about said pulley as said chair is moved from its upright position toward its reclined position and such that said cable is unwound from said pulley as said chair is moved from its reclined position toward its upright position; and second connecting means for interconnecting said seat back to said seat bottom such that said second end of said seat bottom is raised and moved toward said second end of said seat back as said cradle is pivoted in said first arcuate direction during the movement of said chair from its upright position toward its reclined position an such that said second end of said seat bottom is lowered and moved away from said second end of said seat back as said cradle is pivoted in said second arcuate direction during the movement of said chair from its reclined position toward its upright position, said second connecting means including a pair of connector elements, one of said connector elements being attached to said seat back such that said one connector element is movable conjointly with said seat back as said chair is moved between its upright position and its reclined position and the other of said connector elements being attached to said seat bottom and cooperating with said one connector element to control the elevation of said second end of said seat bottom as said second end of said seat bottom is raised and lowered.

25. A reclining chair according to claim 24, wherein said one connector element includes a roller depending from said second end of said seat back and said other connector element includes a bearing surface attached to said seat bottom, said roller being movable along said bearing surface.

* * * * *